US005211023A

United States Patent [19]

Matsuura

[11] Patent Number: 5,211,023

[45] Date of Patent: May 18, 1993

[54] APPARATUS AND METHOD FOR HEATING AND COOLING WITH A REFRIGERANT

[75] Inventor: Takaaki Matsuura, Ibaraki, Japan

[73] Assignee: Union Kogyo Kabushiki Kaisha, Osaka, Japan

[21] Appl. No.: 729,289

[22] Filed: Jul. 12, 1991

[30] Foreign Application Priority Data

Aug. 30, 1990 [JP] Japan ..... 2-230036

[51] Int. Cl.[5] ..... F25B 5/02

[52] U.S. Cl. ..... 62/117; 62/201; 62/238.6

[58] Field of Search ..... 62/117, 201, 238.6, 62/238.7

[56] References Cited

U.S. PATENT DOCUMENTS

| | | | |
|---|---|---|---|
| 3,017,162 | 1/1962 | Haines et al. | 62/238.6 X |
| 4,502,292 | 3/1985 | Ares et al. | 62/238.6 |
| 4,592,206 | 6/1986 | Yamazaki et al. | 62/238.6 X |
| 4,646,537 | 3/1987 | Crawford | 62/238.6 |

*Primary Examiner*—John Rivell

*Attorney, Agent, or Firm*—Armstrong, Westerman, Hattori, McLeland & Naughton

[57] ABSTRACT

An apparatus and a method for heating and cooling with a refrigerant wherein the refrigerant is compressed by a compressor, and circulated to and from the compressor through a condenser, an expansion valve and an evaporator, in this order. A first fluid is heated with the heat generated in the condenser, and a second fluid is cooled with the cooling effect or cold generated in the evaporator. When heat is low and a temperature of the first fluid is decreased, the flow passages of the refrigerant are changed from entering into the evaporator to entering into a second heat-exchanger wherein the refrigerant is heated, and the heated refrigerant is entered into the compressor and circulated. When the cooling effect or cold is low and a temperature of the second fluid is increased, the flow passages of the refrigerant are changed from entering into the condenser to entering into a first heat exchanger wherein the refrigerant is cooled, and the cooled refrigerant is entered into the evaporator and circulated.

2 Claims, 7 Drawing Sheets

FIG.2
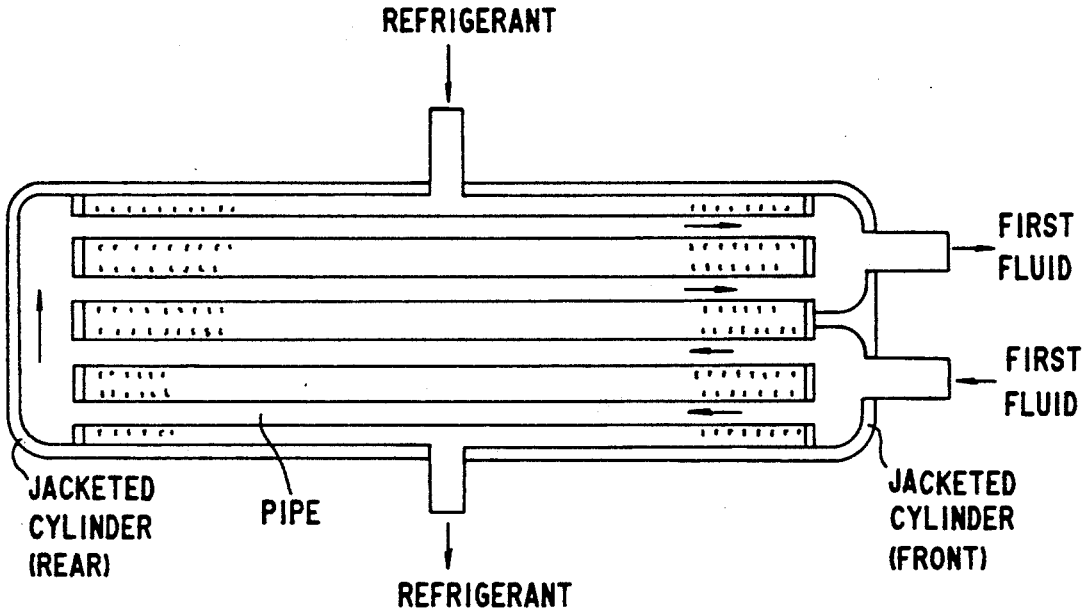
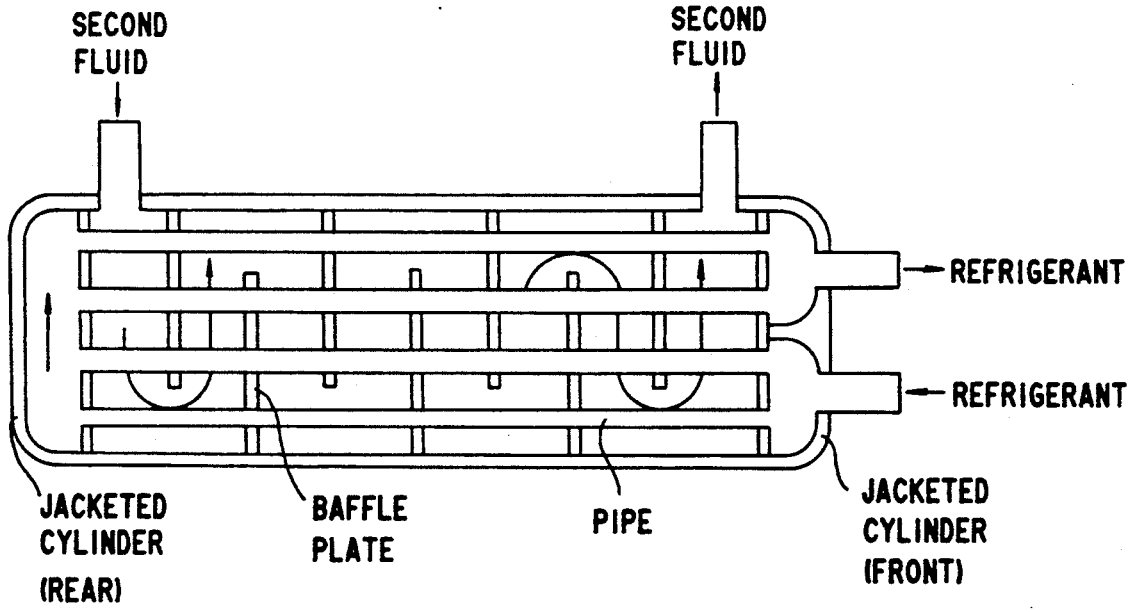
FIG.3

APPARATUS AND METHOD FOR HEATING AND COOLING WITH A REFRIGERANT

BACKGROUND OF THE INVENTION

1. Field of the Invention

This invention generally relates to a method for heating and cooling by means of a refrigerant, and an apparatus therefor.

2. Discussion of the Relevant Art

A method and an apparatus for heating and cooling with a refrigerant are already known. A conventional method for conditioning the air and an apparatus therefor is a heat pump. This method is to transfer the heat by circulating the refrigerant from a compressor back to the compressor through a condenser, expansion valve and evaporator. Since, in this method, the refrigerant generates or irradiates heat or creates a heating effect in the condenser, and absorbs heat or creates a cooling effect in the evaporator, the heat generated in the condenser is used when a room is to be heated, while the cooling effect created in the evaporator is used when the room is to be cooled. In order to have this accomplished, it is required to reverse the flow of the refrigerant dependent on whether the room is to be heated or to be cooled, and a four-way valve has been set up for changing flow of the refrigerant. In the conventional air conditioning, by means of the heat pump, the heat generated in the condenser is abandoned in open air when the room is to be cooled, and the cooling effect generated in the evaporator is abandoned in the open air when the room is to be heated. Thus, either heat or cold is always abandoned into the air.

Besides the air conditioning apparatus, there is a refrigerator in the apparatus for heating and cooling with the use of refrigerant. The refrigerator works based on the same principle as that used in the heat pump when the room is to be cooled, as discussed above. More particularly, this principle is such that the refrigerant is compressed by the compressor, directed from the condenser to the evaporator through the expansion valve, then returned to the compressor and circulated, and while the refrigerant is being circulated, brine and other anti-freezing solution is cooled by the cold generated in the evaporator, thereby obtaining a low temperature. In the refrigerator, the heat generated in the evaporator is absorbed by water and so on, which has been abandoned.

As discussed above, the heat generated in the case of cooling a room, and the cold generated in the case of heating a room are abandoned in the conventional air conditioning. In the case of the refrigerator, the cold alone is used, while the heat is abandoned. The reasons why either the heat or cold is abandoned, as discussed above, are based on the facts that the abandoned heat or cold has not reached a temperature for effective use and further that the abandoned heat or cold has not reached a sufficient amount worthy for effective use. However, it is to be noted that either the heat or the cold becoming abandoned is uneconomical when considered from a viewpoint of effective use of energy.

It is therefore an object of this invention to make effective use of both the heat and the cold generated in the conventional heating and cooling methods which makes use of a refrigerant. In order to accomplish this objective, the heat and the cold should be transferred separately to respective fluids, and . the temperature of fluid heated by the heat should be elevated and the temperature of another fluid cooled by the cold should be lowered, thereby producing a significant difference between the temperatures of the heated fluid and the cooled fluid.

SUMMARY OF THE INVENTION

The aforementioned and other objects of the present invention are accomplished by providing at least one auxiliary passage besides the conventional passages so that the refrigerant flows in the conventional passages, but flows in the auxiliary passage in cases specified hereinbelow, and the temperature of the refrigerant itself is regulated. When operated in the manner discussed above, there is a significant difference between the temperatures of the heated fluid and the cooled fluid, and effective use can be made of both the heat and the cold. This invention is provided based on the findings described above.

According to one embodiment of this invention, there is provided an apparatus for heating and cooling with a refrigerant, wherein the apparatus compresses the refrigerant by a compressor and the refrigerant is circulated to or from a compressor through a condenser, expansion valve and evaporator in this order. A fluid is heated by the heat generated in the condenser and another fluid is cooled by the cold generated in the evaporator.

The apparatus of this invention includes an auxiliary hot passage which connects the compressor and the expansion valve, passes through a first heat-exchanger, and is provided in parallel and mutually changeable relation to the conventional passage passing through the condenser. The apparatus of this invention also includes an auxiliary cold passage which connects the expansion valve and the compressor, passes through a second heat-exchanger, and is provided in parallel and mutually changeable relation to the conventional passage passing through the evaporator.

According to another aspect of the present invention, there is provided a method for heating and cooling with a refrigerant, wherein the refrigerant is compressed by a compressor and circulated to or from the compressor passing through a condenser, expansion valve and evaporator in this order, and wherein a first fluid is heated by the heat generated in the condenser, and a second fluid is cooled by the cold generated in the evaporator. In the method of this invention, when the heat is short and a temperature of the first fluid is lowered, a change is made of the flow passages of the refrigerant from entering into the evaporator so as to enter into a second heat exchanger, wherein the refrigerant is heated, and the heated refrigerant is entered into the compressor and circulated. Also, when the cold is short and a temperature of the second fluid is elevated, a change is made of flow passages of the refrigerant from entering into the condenser so as to enter into a first heat-exchanger, wherein the refrigerant is cooled, and the cooled refrigerant is entered into the evaporator and circulated.

These and other features of the invention will be understood upon reading of the following description along with the drawings.

BRIEF DESCRIPTION OF THE DRAWINGS

FIG. 2 is a cross-sectional view of a condenser used in the present invention;

FIG. 3 is a cross-sectional view of an evaporator used in the present invention;

DESCRIPTION OF THE PREFERRED EMBODIMENTS

Figure 1:
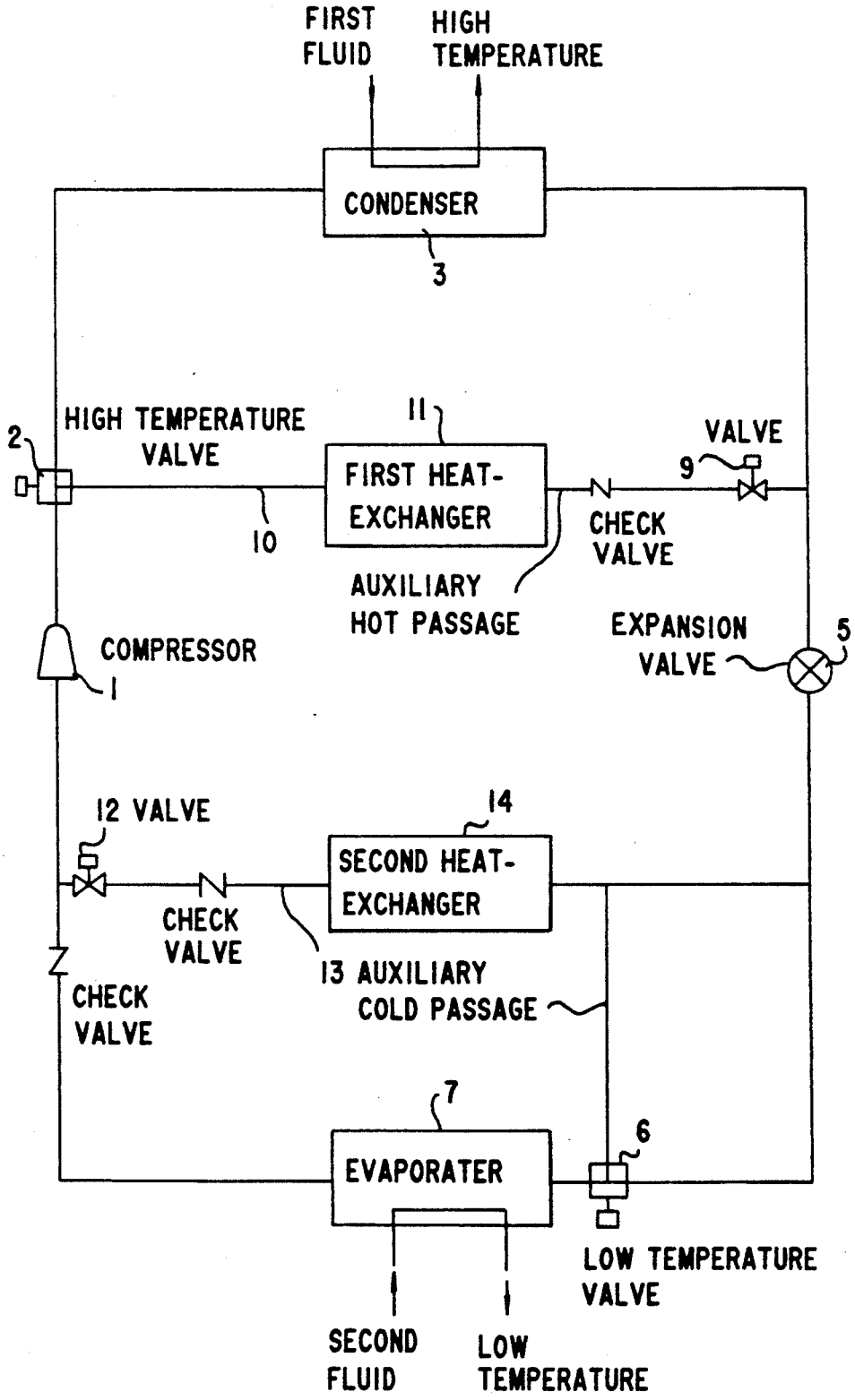
FIG. 1 is a block diagram showing a principle for a heating and cooling apparatus according to the present invention.

In FIG. 1, reference numeral 1 denotes a compressor, 2 denotes a high temperature valve, 3 denotes a condenser, 5 refers to an expansion valve, 6 refers to a low temperature valve, 7 denotes an evaporator, 9 refers to a valve, 10 denotes an auxiliary hot passage, 11 is a first heat-exchanger, 12 refers to a valve, 13 denotes an auxiliary cold passage, and 14 refers to a second heatexchanger.

A part of the apparatus as shown in FIG. 1 is known; i.e., an apparatus is known, wherein the refrigerant is compressed by compressor transferred to condenser 3, passed through expansion valve 5 and evaporator 7, and returned back to the compressor 1.

The apparatus according to this invention includes two sets of auxiliary passages which are additionally attached to the known apparatus in order to pass the refrigerant into the auxiliary passage when needed. In the just-mentioned two sets of auxiliary passages, one is an auxiliary hot passage, while the other is an auxiliary cold passage. The auxiliary hot passage is passage 10, which is to introduce the refrigerant to a first heat exchanger 11, and then to expansion valve 5 without entering the refrigerant into condenser 3. In order to enable the conventional passage to be substituted by the auxiliary hot passage 10, a high temperature valve 2 is provided between compressor 1 and condenser 3, and valve 2 makes it possible to alternately flow the refrigerant into either the condenser 3 or the auxiliary hot passage 10. Furthermore, a valve 9 is provided on the outlet side of auxiliary hot passage 10.

An auxiliary cold passage 13 introduces the refrigerant to a second heat exchanger 14, and then to compressor 1 without entering the refrigerant into evaporator 7. In order to enable the conventional passage to be substituted by the auxiliary cold passage 13, a low temperature valve 6 is provided between expansion valve 5 and evaporator 7, and valve 6 makes it possible to alternately transfer the refrigerant into either evaporator 7 or auxiliary cold passage 13. Further, a valve 12 is provided on the outlet side of auxiliary cold passage 13.

The first heat exchanger is for cooling the refrigerant by air or water at an ambient temperature. Also, the second heat exchanger is heating the refrigerant by air or water at an ambient temperature. The refrigerant can be cooled by the air or water at the ambient temperature on one side and heated by the air or water at the same ambient temperature on the other side since the refrigerant has a temperature considerably higher than the ambient temperature at the first heat-exchanger and a temperature considerably lower than the ambient temperature at the second heat-exchanger. These heat exchangers are attached based on the fact that the heating and cooling in the heat exchangers are effective for obtaining a lower temperature and higher temperature.

The apparatus according to this invention is provided with two auxiliary passages 10, 13. In the apparatus of this invention, the refrigerant is normally circulated such that it is run from compressor 1, passed through condenser 3, expansion valve 5 and evaporator 7 in this order, and returned back to compressor 1. However, when the cold is short in the second fluid, the refrigerant is circulated such that it is run from compressor 1, entered from high temperature valve 2 to auxiliary hot passage 10, passed through first heat exchanger 11, expansion valve 5 and evaporator 7, and returned back to compressor 1. Furthermore, when the heat is short in the first fluid, the refrigerant is circulated such that it is run from compressor 1, passed through condenser 3 and expansion valve 5, then entered from low temperature valve 6 to auxiliary cold passage 13, passed through the second heat exchanger 14, and returned back to compressor 1.

In this invention, however, it is not possible for the refrigerant flowing from compressor 1 to pass through auxiliary hot passage 10, as well as through auxiliary cold passage 13.

The method for heating and cooling with a refrigerant according to the present invention is a method for heating and cooling the fluids using the apparatus shown in FIG. 1. Thus, the method of this invention is more particularly explained below with reference to FIG. 1.

At the outset, the refrigerant is compressed by compressor 1, run into condenser 3, then passed through expansion valve 5, transferred into evaporator 7, and thereafter, returned back to compressor and is thus circulated. During the circulation, the refrigerant generates the heat in the condenser 3 which is used for heating a first fluid, and simultaneously, the refrigerant generates the cold in the evaporator 7 which is used for cooling a second fluid, and thus, both the heat and the cold are utilized.

Insofar as demand for the heat by the first fluid is almost equal to and balanced with demand for the cold by the second fluid, the refrigerant is circulated in the normal manner. Actual demand of the heat is not always balanced with that of the cold. More particularly, sometimes the demand for the heat is increased, but the demand for the cold is decreased or sometimes, the demand for the cold is increased, but the demand for the heat is decreased.

When heat is demanded in a substantial amount, but the cold is demanded only in a small amount, a great deal of heat is required to be additionally generated in the condenser 3. For this reason, the refrigerant flowing into the condenser 3 is required to be of a higher temperature. A flow change is then made of the refrigerant so as to introduce the refrigerant into auxiliary cold passage 13 without introducing the refrigerant into evaporator 7. The refrigerant is passed through a second heat-exchanger 14 provided by way of the auxiliary cold passage 13, wherein the refrigerant is heated. For this reason, a low temperature valve 6 is closed towards evaporator 7, but is opened to auxiliary cold passage 13, and a valve 12 is also opened.

The refrigerant, when being entered into the auxiliary cold passage 13, is usually of a temperature lower than the ambient temperature. Thus, the refrigerant in the second heat-exchanger 14 can be heated by the ambient air or water. In the apparatus according to the present invention, the temperature of the refrigerant can be elevated in the second heat-exchanger 14 just by exchanging the heat with the ambient air or water, and the heat in condenser 3 can be increased. Consequently, the heat shortage in the condenser 3 can be avoided. Thus, the first fluid can be maintained at a high temperature.

In contrast, when the cold is demanded in a large amount and the heat is demanded only in a small amount, a significant amount of the cold should be additionally generated in evaporator 7. For this reason, the refrigerant flowing in the evaporator 7 is required to be at low temperature. In order to meet this demand, a flow change is made of the refrigerant so that the refrigerant is introduced into auxiliary hot passage 10 without introducing the refrigerant into condenser 3, and the refrigerant is cooled in a first heat exchanger 11 which is provided on the path of auxiliary hot passage 10. In order to maintain the passage 10 open, high temperature valve 2 is closed towards the condenser 3, but is opened towards auxiliary hot passage 10, and valve 9 is opened.

The refrigerant, when being entered into the auxiliary hot passage 10, is usually of a temperature higher than the ambient temperature. Thus, the refrigerant in the first heat-exchanger 11 can be cooled by exchanging the heat with the ambient air or water. In the apparatus according to the present invention, the temperature of the refrigerant is lowered in the first heat-exchanger just by heat conduction of the ambient air or water, and the cold in the evaporator 7 can be increased. As a result, the cold shortage in evaporator 7 can be avoided. Thus, the second fluid can be maintained at a lower temperature.

In the method according to the present invention, the refrigerant is transferred into the first heat-exchanger 11 only when the first fluid running out of condenser 3 is at a sufficient temperature, but the second fluid running out of the evaporator 7 is short of cooling; i.e., at a temperature higher than a desired low temperature. Likewise, the refrigerant is transferred into second heat-exchanger 14 only when the second fluid is at a sufficient temperature, but the first fluid is short of heat; i.e., at a temperature lower than a desired high temperature. Otherwise, the refrigerant is circulated to and from the compressor 1 through condenser 3, expansion valve 5, and evaporator 7, as in the conventional manner.

The condenser 3 used in the present invention is the same as the condenser used in the conventional heat pumps. FIG. 2 shows a typical condenser. The condenser, as shown in FIG. 2, is designed so as to have the structure whereby a plurality of metal pipes are placed in a jacketed cylinder in a mutually parallel and communicating relationship. The first fluid is transferred in the metal pipes in the direction indicated by an arrow, and the refrigerant is transferred outside of the metal pipes, and thus, the heat exchange between the first fluid and the refrigerant is carried out. In order to carry out the heat exchange effectively, a number of fins are provided on the outer surface of the metal pipes to increase a heat conduction area.

The evaporator 7 used in the present invention is the same as the evaporator used in the conventional heat pumps. FIG. shows a typical evaporator. The evaporator, shown in FIG. 3, is designed so as to have the structure whereby a number of metal pipes are placed in a jacketed cylinder in a mutually parallel and communicating relationship. The refrigerant is transferred in the metal pipes in the direction indicated by an arrow, and the second fluid is transferred outside of the metal pipes so that the heat exchange can be carried out between the second fluid and the refrigerant. Over the metal pipes are a plurality of baffle plates which are extended in the direction perpendicular to the axis of the metal pipes, and partially blocked inside of the jacketed cylinder so that the second fluid may advance around the metal pipes in a zigzag directional flow in the cylinder so as to effectively carry out the heat exchange between the refrigerant and the second fluid.

Figure 4:
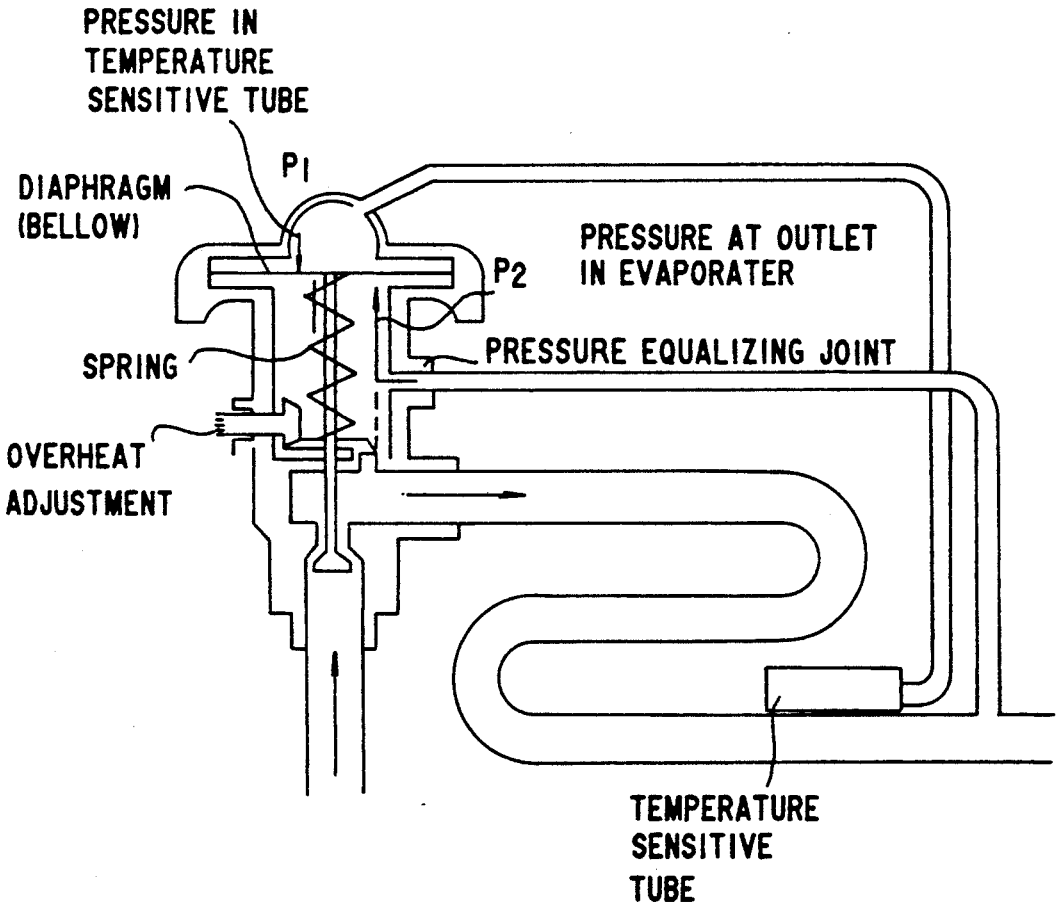
FIG. 4 is a cross-sectional view of an expansion valve used in the present invention.

The expansion valve 5 of the present invention may be the conventional expansion valves which have been used in heat pumps. FIG. 4 shows a typical example of the expansion valves used in this invention. The expansion valve illustrated in FIG. 4 is designed so as to be able to adjust a pressure necessary for opening the valve by a pressure of the refrigerant sealingly held above a diaphragm, and by a pressure of a spring set under the diaphragm, and also, to thereby be able to automatically and appropriately send the refrigerant to the evaporator 7.

In the present invention, the conventional compressors which have been used in the heat pumps may be used for the compressor 1. A turbo-compressor, screw compressor, reciprocating compressor, rotary compressor or scroll compressor may be used, whereby the screw compressor is preferable and a multiple stage screw compressor is most preferable .

In the present invention, check valves are sporadically provided on the passages for the refrigerant in order to prevent the refrigerant from running in a reverse manner in the passages, and the check valves are not different from the conventional check valves.

In the present invention, high temperature valve 2, low temperature valve 6, and valves 9, 12 are also used, but these valves are noted here for the sake of convenience and are not different from the conventional valves which are used for opening or closing the passages for the refrigerant.

The present invention includes a first heat-exchanger 11 and a second heat-exchanger 14. The first heat exchanger is to cool the refrigerant by the ambient air or water, while the second heat exchanger 14 is to heat the refrigerant by the ambient air or water. These two heat-exchangers are solely used for carrying out the heat exchange between the refrigerant and the air or water, and may have the same structure. Furthermore, these two heat exchangers are not used simultaneously in the present invention, and one heat-exchanger can be used for the first heat-exchanger, as well as the second heat-exchanger when a valve is provided and operated to run the refrigerant into the heat-exchanger so that it may act as either the first heat-exchanger or the second heat-exchanger.

Figure 5B:
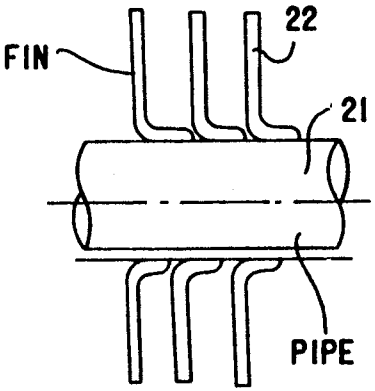
FIG. 5 is a perspective view (A) of the first and/or second heat exchanger; and a partly cut away and enlarged view (B) thereof.
Figure 5A:
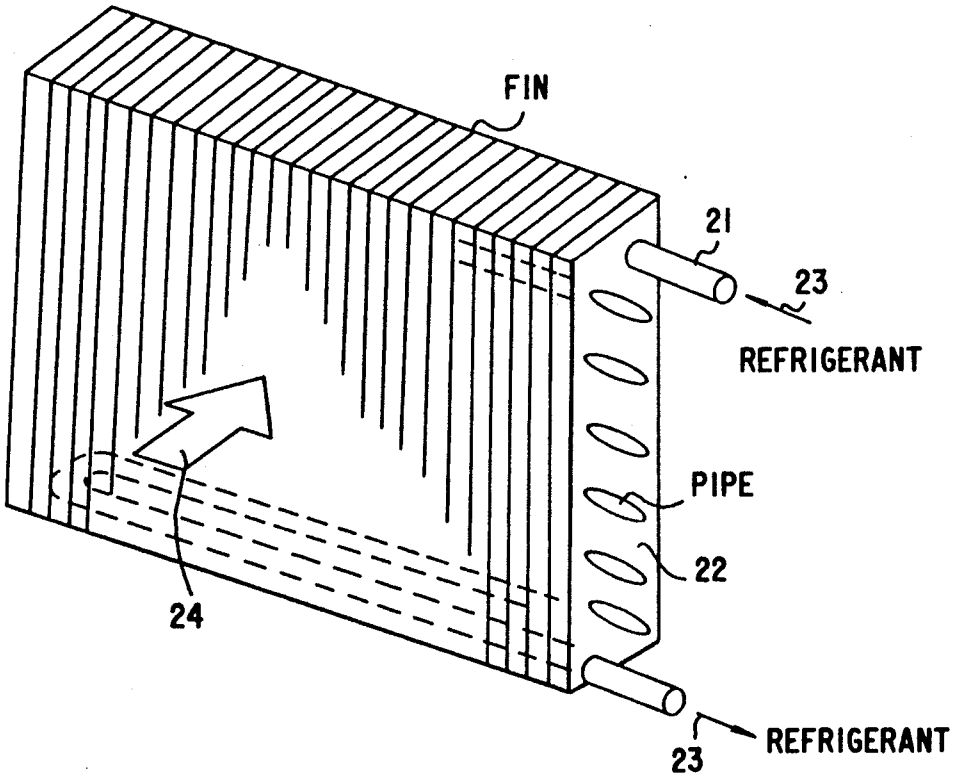

FIG. 5 shows an example of the heat exchangers which may be used as the first heat-exchanger and the second heat-exchanger 14. The heat-exchanger, as shown in FIG. 5, has a number of rectangular fins 22 which are fixed in mutually parallel relation to a meandering metal tube 21, and since each fin significantly projects from the tube, the heat-exchanger appears to be configured as a rectangular parallel-piped type including fins 12 placed in parallel to each other at a first glance. In the heat-exchanger, the refrigerant flows into the inner portion of tube 21 in the direction indicated by an arrow 23. On the other hand, the air is directed in the direction indicated by an arrow 24 and entered into the intervals of fins 22, wherein the heat exchange is carried out, and the refrigerant is heated or cooled by the air.

The first heat exchanger 11 and the second heat exchanger 14 are the same as condenser 3 and evaporator 7 in that they are all heat-exchangers. The first heat-exchanger 11 and the second heat-exchanger 14 are different from the condenser 3 and evaporator 7 in that the former has a larger heat conduction area than the latter by more than 20%. The heat conduction area is preferably increased by more than 50%, more preferably by more than 100%.

In the present invention, the refrigerant is usually circulated from compressor and back to compressor through condenser 3, expansion valve 5, and evaporator, as described above. During this circulation, the refrigerant generates, in condenser 3, the heat which is used for heating the first fluid, and the refrigerant generates in evaporator 7 the cold which is used for cooling the second fluid.

In actual operation, a temperature of the first fluid is measured, and the operation is such that the measured temperature falls within a desired high temperature range. Similarly, a temperature of the second fluid is measured and the operation is such that the measured temperature falls within a desired low temperature range; thereby controlling the compressor 1.

When both the temperature of the first fluid and the temperature of the second fluid are outside of the respective desired temperatures, the apparatus, as shown in FIG. 1, is set in motion by opening the high the temperature valve 2 and the low temperature valve 6 so that the refrigerant may be passed through both condenser 3 and evaporator 7, as discussed above. In other words, the apparatus is operated in a conventional manner during the start of operations.

When the temperature of the first fluid is decreased to a temperature outside of a desired high temperature range, even if the temperature of the second fluid, is within a desired low temperature range, the refrigerant is not entered into evaporator 7, but is entered instead into the second heat-exchanger 14. A change of the refrigerant passage is made at this stage by opening the low temperature valve 6 to the auxiliary cold passage 13, by closing a passage towards evaporator 7, and by opening valve 12. The valves 6, 7, 12 are typically opened and closed or controlled by a computer.

When the refrigerant is not entered into the evaporator 7 but is entered into second heat exchanger 14, since the refrigerant is not evaporated and does not lose the heat, the refrigerant is not only advanced to the compressor 1 having a temperature higher than before but is also heated by the ambient air or water in the second heat exchanger so that the refrigerant is advanced having a higher temperature. Accordingly, the refrigerant, on entering into condenser 3, is at a high temperature, and an amount of the heat transferred to the first fluid by heat exchange in the condenser 3 is increased followed by the elevation of the temperature of the first fluid.

Conversely, when the temperature of the first fluid is within a desired temperature range, and the temperature of the second fluid is instead elevated up to a temperature outside of a desired low temperature range on account of the cold shortage, the refrigerant is not entered into the condenser 3, but entered into the first heat exchanger 11. A change of the refrigerant passage is made at this stage by opening the high temperature valve 2 to the auxiliary hot passage 10, closing a passage towards the condenser 3 and the opening valves 9. These valves are typically opened and closed or controlled by a computer.

When the refrigerant is not entered into condenser 3 and is, instead, entered into the first heat exchanger the refrigerant does not lose condensation heat in condenser 3, but is cooled by the ambient air or water in the first heat exchanger so that the refrigerant is entered into the evaporator having a lower temperature than before. Thus, the refrigerant, when entering into the evaporator 7, has the lower temperature, and an amount of the cold transferred to the second fluid by heat exchange in the evaporator 7 is increased, and the lowering of the temperature of the second fluid is then followed.

In the operation of the present invention, a temperature t of the first fluid running out of condenser 3, and a temperature T of the second fluid running out of evaporator 7 are measured, and these values t, T are inputted into a computer. On the basis of the inputted data, the compressor I, the high temperature valve 2, the low temperature valve 6, the expansion valve 5, and the valves 9, 12 are appropriately operated so that the apparatus works automatically.

According to the apparatus and the method of this invention, with the apparatus having a small volume compared with the conventional apparatuses and methods, the first fluid can be heated; the second fluid can also be cooled; a temperature difference can be increased between the first fluid and the second fluid; and thus, effective use can be made of both the heat and cold.

For example, in the conventional apparatuses and methods, the first fluid is at about 45° C. and the second fluid is at about 7° C. However, according to the present invention, the first fluid can be elevated up to 58° C. and the second fluid up to −20° C. The volume of the apparatus can be decreased less than one third of the conventional apparatus having the same caloric power.

Moreover, according to the method of this invention, the temperature difference between the first fluid and the second fluid can be increased by using a mixture of refrigerants having different boiling points. In this case, reservoirs for the refrigerants are provided on the passageways for the refrigerants. A mixing rate is controlled by the circulating refrigerants, a plurality of expansion valves are provided, each valve being suited for each refrigerant, and the selection and use are made of the expansion valves according to the circulating refrigerants.

Figure 6:
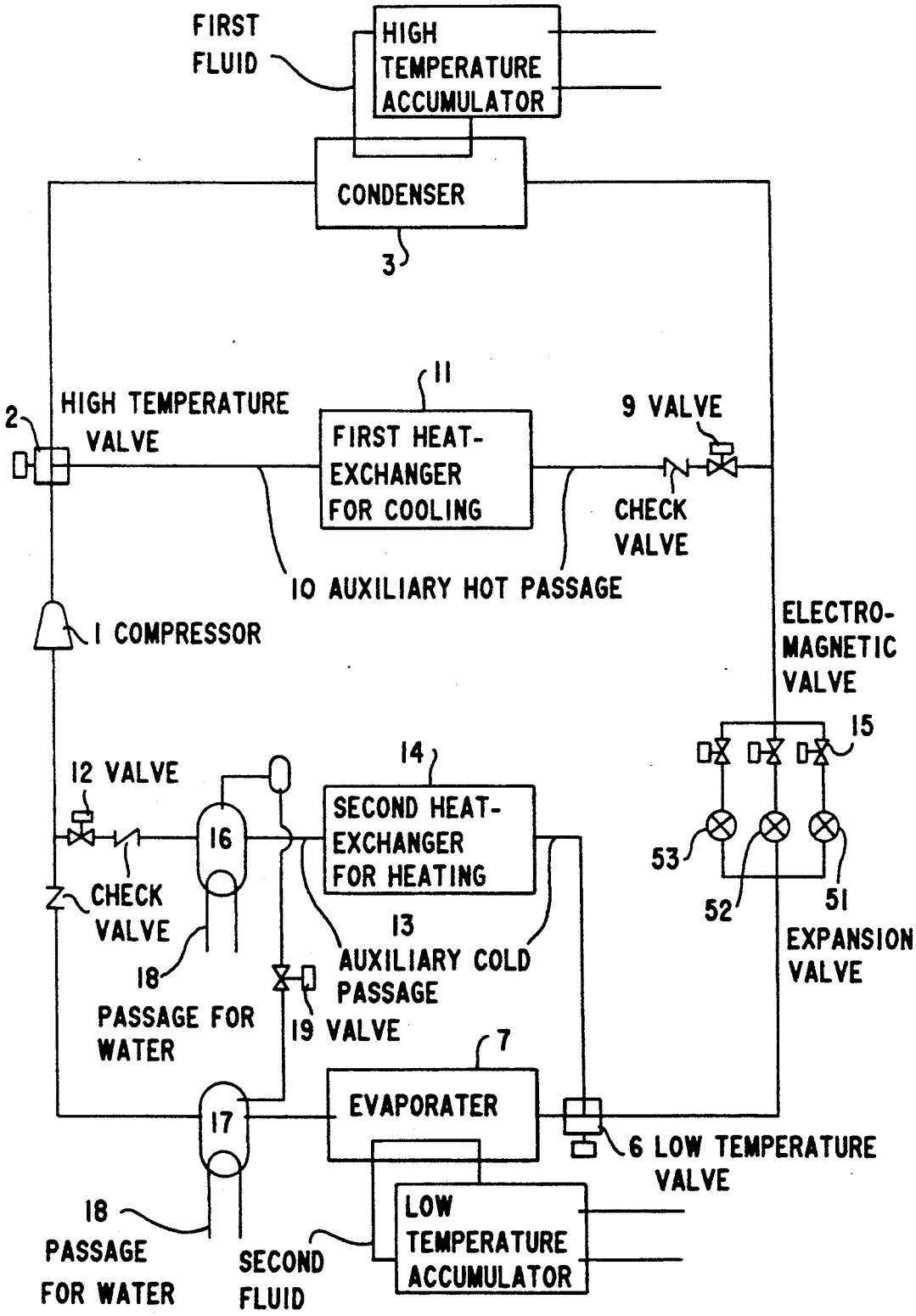
FIG. 6 illustrates a principle of another heating and cooling apparatus according to the present invention.

FIG. 6 shows a schematic view of an example, wherein a mixture of the refrigerants is used. The apparatus, as shown in FIG. 6, is different from the apparatus as shown in FIG. 1 in that the three expansion valves 51, 52, 53 are provided in parallel instead of a single expansion valve 5, and a valve 15 is also provided at the inlet side of each expansion valve. Furthermore, two reservoirs for the refrigerants 16, 17 are provided in parallel between evaporator 7 and compressor 1, and passage 18 for water, either hot or cold, is attached to each of the reservoirs for controlling the temperature of the inner portion of each reservoir 16 or 17. When an electron expansion valve is used, it is not required to provide three expansion valves, but just one electron expansion valve is sufficient.

The apparatus, as shown in FIG. 6, is different from that shown in FIG. 1 in that a hot tank is provided so as to make it possible to store therein a large amount of the first fluid and hence, to continually supply a larger amount of the heat. Also, a cold tank is provided so as to make it possible to store therein a large amount of the second fluid, and hence to supply a large amount of the cold.

In the apparatus shown in FIG. 6, a refrigerant reservoir 16 is set for regulating a temperature of the refrigerant, for evaporating a refrigerant having a low boiling point from a non-azeotropic mixture of refrigerants to separate the mixture, also for running the refrigerant into a refrigerant reservoir 17 through valve 19, and for reserving in reservoir 16 the refrigerant having a high boiling point. The refrigerant reservoir 17 cannot separate the non-azeotropic mixture of refrigerants, but can regulate the temperature of the refrigerant, and also can act as a reservoir for the refrigerant having a low boiling point. Thus, the refrigerant having a high boiling point and the refrigerant having a low boiling point are always stored in refrigerant reservoirs 16 and 17, respectively, and the amount of each of the refrigerants stored in the reservoir is one-third of the total circulating refrigerant.

In the apparatus shown in FIG. 6, when the temperature of the second fluid is to be further decreased, the refrigerant having the lower boiling point is selected among the non-azeotropic mixture of three kinds of refrigerants and is run from the compressor 1 to the first heat exchanger 11, then is passed through the evaporator, and is thus circulated.

To this end, the temperature valve 6 is opened towards the auxiliary cold passage 13, and the refrigerant is passed through the second heat exchanger 14, entered into the refrigerant reservoir 16, in which the refrigerant is heated by water running in water passage 18, and the refrigerant having a low boiling point is evaporated, and thus evaporated refrigerant is passed through the valve 19, entered into the refrigerant reservoir 17, and thus the refrigerant having a high boiling point is remained and stored in the refrigerant reservoir 16. When the low temperature valve 6 is opened towards the evaporator 7, the refrigerant of a low boiling point entered in the refrigerant reservoir 17 is run into compressor 1 and the high temperature valve 2 is opened towards auxiliary hot passage 10. Thus, the refrigerant running from compressor 1 is entered into the high temperature valve 2, auxiliary hot passage 10 and the first heat-exchanger 11, in which the refrigerant is cooled, and thus cooled refrigerant is passed through valve 9, expansion valves 51–53, subsequently entered into evaporator 7, in which the refrigerant decreases further the temperature of the second fluid, thereafter is returned to compressor 1 and thus circulated.

In the apparatus in FIG. 6, when the temperature of the first fluid is to be further increased, the refrigerant having a high boiling point is selected among the mixture of three kinds of refrigerants and is run from the compressor 1 to the condenser 3, then entered into the second heat exchanger 14, subsequently returned to the compressor 1, and is thus circulated.

To this end, the low temperature valve 6 is closed towards the evaporator 7 but is opened towards the auxiliary cold passage 13 to run the refrigerant into the second heat exchanger 14, then into the refrigerant reservoir 16, in which the non-azeotropic mixture of refrigerant is heated by the water running in the water passage 18, and the refrigerant having a low boiling point is evaporated, and thus evaporated refrigerant is passed through valve 19, and entered into and remained in the refrigerant reservoir 17, while the refrigerant having a high boiling point is returned to compressor 1 by opening valve 12, and is thus circulated.

Thus, the refrigerant of a high boiling point running from the compressor 1 is entered into the condenser 3, heats the first fluid to a higher temperature, then is passed through the expansion valves 51–53, the low temperature valve 6, auxiliary cold passage 13, and then the second heat exchanger 14, wherein heated, then is passed through the refrigerant reservoir 16, valve 12, returned to the compressor 1, and is thus circulated. In this case, a specific expansion valve suited for passing the refrigerant having the high boiling point is selected from among the expansion valves 51, 52, 53, and the refrigerant having the high boiling point is passed through the specific expansion valve.

When the apparatus in FIG. 6 operates in the manner as discussed above, a temperature difference can be significantly increased between the first fluid and second fluid. For example, when a single refrigerant is used, the first fluid can be elevated up to 58° C., the second fluid can be lowered until −20° C., and the difference can be increased up to 78° C. Meanwhile, when a mixture consisting of three kinds of refrigerants (e.g., consisting of "FREON R11" (boiling point 23.82° C., molecular formula $CCl_3F$) 40%, "FREON R12" (boiling point −29.79° C.) molecular formula $CCl_2F_2$) 40%, and "FREON 13B1" (boiling point −57.75° C., molecular formula $CBrF_3$) 20%) is used, and the apparatus is operated in the manner discussed above, the first fluid can be elevated up to 150° C., the second fluid can be lowered up to −50° C., and the temperature difference can be increased up to 200° C.

When a mixture of the refrigerants is used, the reservoir 16 for the refrigerant is required between the valve 12 and the second heat exchanger on the auxiliary cold passage provided in this invention. Also, the reservoir 17 for the refrigerant is provided between the evaporator 7 and the compressor on the conventional passage. A passage for the refrigerant is provided between the reservoirs 16, 17, and a valve 19 is provided on the passage for the refrigerant.

When the apparatus is operated in the conventional manner wherein the refrigerants are passed through both condenser 3 and the evaporator 7, neither reservoir 16 nor reservoir 17 is used; instead, both reservoirs are used only when the refrigerants are passed through the first heat exchanger or the second heat exchanger.

The following examples serve to illustrate this invention and to understand the advantages of the apparatus and method according to this invention.

EXAMPLE 1

Figure 7:
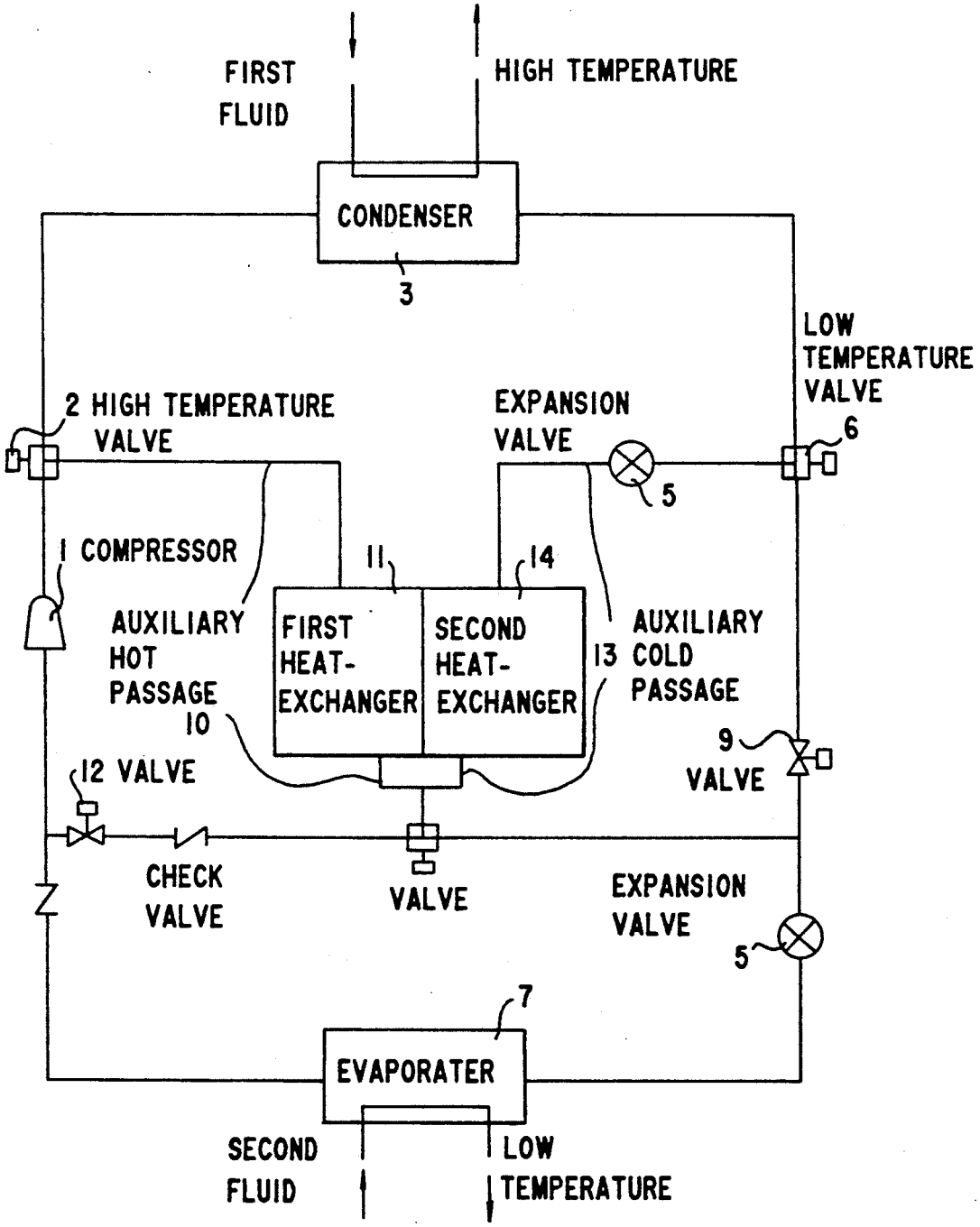
FIGS. 7 and 8 are block diagrams of apparatuses used in the Examples of the present invention.

In this example, the apparatus is provided based on the principle, as shown in FIG. 1, and in actuality, as shown in FIG. 7. A refrigerant made of "FREON R22" (i.e., $CHClF_2$) was used.

A screw compressor of 3KW/hr for the compressor 1 was used. The apparatus was initially operated in the conventional manner by circulating the refrigerant from the compressor 1 to the compressor 1 via the high temperature valve 2, the condenser 3, the low temperature valve 6, the expansion valve 5 and the evaporator 7. At this stage, the refrigerant had a pressure of 4.5KG/cm$^2$ (−3° C.) at a minimum, and a pressure of 25Kg/cm$^2$ (62° C.) at a maximum, and the first fluid running out of condenser 3 had a temperature of 58° C. at a maximum, and the second fluid had a temperature of 7° C. at a minimum.

In this case, the apparatus was set up in order to stop the rotation of the compressor 1 when the first fluid has reached a temperature of more than 58° C., and to have the compressor 1, commence working when the first fluid has reached a temperature of lower than 55° C. Also, the apparatus was set up to commence the working of the compressor 1 when the second fluid has reached a temperature of more than 6° C., but, to stop the working of the compressor 1 when the second fluid has reached a temperature of lower than 3° C.

When the refrigerant has passed through the second heat exchanger 14, instead of having the refrigerant enter the evaporator 7 and heated in the second heat exchanger by water at the ambient temperature of 20° C., the refrigerant can have a minimum pressure of 5 kg/cm$^2$ and a maximum pressure of 26 kg/cm$^2$, and the first fluid can be elevated up to 63° C. Also, when the refrigerant passes through the first heat exchanger 11, instead of having the refrigerant enter the condenser 3 and cooled by the water, the refrigerant can have a minimum pressure of 3.6 kg/cm$^2$ and a maximum pressure of 17 kg/cm$^2$, and the second fluid can be lowered to −10° C.

Thus, when the apparatus is set up so that a temperature of the first fluid is within the range of 55°-58° C., and also the temperature of the second fluid is within the range of 3°-6° C., and the apparatus operated only by automatically operating the high temperature valve 2, low temperature valve 6, valves 12, 19, and compressor 1, hot water and cold water can be continuously obtained which are just within the respective ranges.

Pipes of 19.05$\phi\times$1.2t mm for the condenser 3 having a resisting pressure of 45 kg/cm$^2$G and a heat conduction area of 0.95 m$^2$ were used, and pipes of 9.53$\phi\times$0.41 t mm for the evaporator 7 having a resisting pressure of 42 kg/cm$^2$ and heat conduction area of 2.35 m$^2$ were also used. Pipes of 19.05$\phi\times$2t mm for the first heat exchanger having a resisting pressure of 45 kg/cm$^2$G and a heat conduction area of 1.14 m$^2$ were used, and pipes of 9.53$\phi\times$0.41 t mm for the second heat exchanger having a resisting pressure of 42 kg/cm$^2$G and a heat conduction area of 2.8 m$^2$ were also used.

EXAMPLE 2

Figure 8:
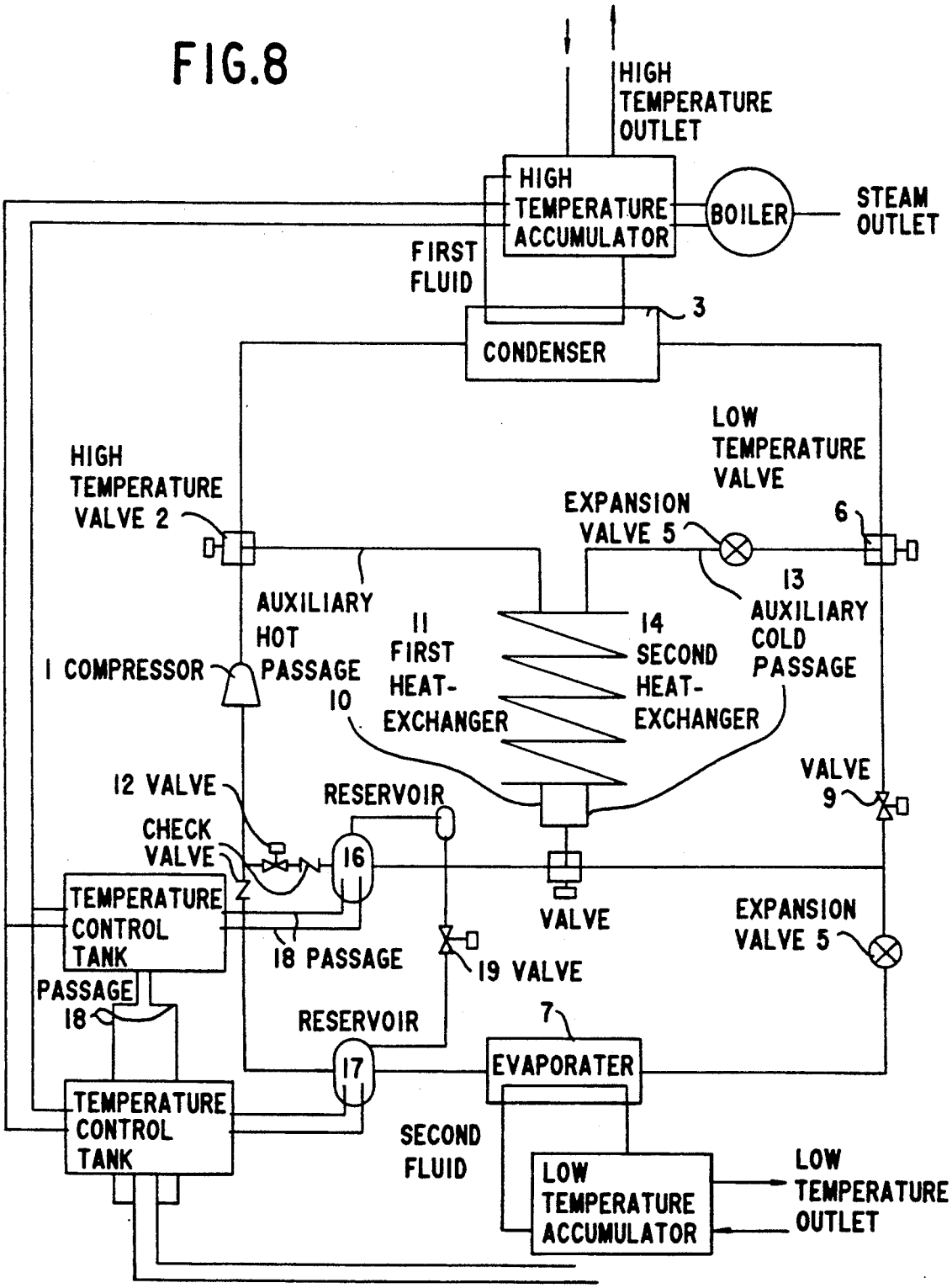

In this example, an apparatus was provided based on the principle as shown in FIG. 6, and was prepared in actuality in the manner as shown in FIG. 8, wherein a mixture of three kinds of refrigerants was used. In this example, a single heat exchanger was used for the first heat exchanger at one time and for the second heat exchanger at another time, this change having been made by the high temperature valve 2 and low temperature valve 6. The following three kinds of refrigerants were used for the refrigerant:

| Trade name of refrigerant | Boiling point | Molecular formula | Mixing ratio (% by weight) |
|---|---|---|---|
| FREON R11 | 23.82 | $CCl_3F$ | 40 |
| FREON R12 | −29.79 | $CCl_2F_2$ | 40 |
| FREON 13B1 | −57.75 | $CBrF_3$ | 20 |

A screw compressor of 3 KW/hr was used for the compressor 1. Initially, a mixture of the three kinds of refrigerants was circulated from compressor 1 to compressor 1 through the high temperature valve 2, condenser 3, low temperature valve 6, expansion valve 5 and evaporator 7 in order to operate with the apparatus in a conventional manner. In this case, the refrigerant had a minimum pressure of 4.5 kg/cm$^2$ (−5° C.) and a maximum pressure of 25 KG/cm$^2$ (85° C.), wherein the first fluid running out of the condenser 3 had a maximum temperature of 85° C., and the second fluid running out of the evaporator 7 had a minimum temperature of −5° C.

The apparatus was set up so that the compressor 1 may be stopped when the first fluid was elevated above 85° C., while the compressor 1 may be operated when the first fluid was lowered below 82° C. The apparatus was also set up so that the compressor 1 may be stopped when the second fluid was lowered below −5° C., while the compressor 1 may be operated when the second fluid was elevated above −2° C.

When the refrigerant flowed into the second heat exchanger 14, instead of the evaporator 7, to heat the refrigerant in the second heat exchanger 14 by the air at the ambient temperature, and "FREON R11" was primarily circulated in the mixture of the refrigerant, the refrigerant had a minimum pressure of 5 kg/cm$^2$ and the maximum pressure of 23 kg/cm$^2$, and the first fluid was elevated up to a maximum temperature of 150° C. and a minimum temperature of 70° C.

At this time, in order to primarily circulate "FREON R11" as the refrigerant, the refrigerant running out of the second heat exchanger 14 was directed into the reservoir 16, wherein a temperature of 2° C. was maintained. Then, "FREON R12" and "FREON 13B1" in the mixture, when the valve 19 was opened, were run into the reservoir 17, and the refrigerant "FREON R11" was primarily circulated.

When the refrigerant flowed into the first heat exchanger 11, instead of into the condenser 3, to cool the refrigerant in the first heat exchanger 11 by the air at the ambient temperature, and "FREON R12" and "FREON 13B1" were primarily circulated in the mixture of the refrigerant, the refrigerant had a minimum pressure of 0.4 kg/cm$^2$ and a maximum pressure of 9 kg/cm$^2$, and the second fluid was lowered to a maximum temperature of 35° C. and a minimum temperature of −50° C.

At this time, in order to primarily circulate "FREON R12" and "FREON 13B1", the refrigerant running out of the first heat exchanger 11 was directed into reservoir 17, wherein a temperature of 2° C., and wherein "FREON R12" and "FREON13B1" were liquefied and retained in reservoir 17, and only unliquefied "FREON R11" was transferred to reservoir 16 by opening a valve 19; thereby, further cooling the "FREON R11" in the reservoir 16 to be liquefied, and the "FREON R12" and the "FREON13B1" retained in the reservoir 17 were thus circulated.

When the apparatus was set up so that the first fluid may be within a temperature range of 142° C. to 150° C., and the second fluid may be within a temperature range of −42° C. to −50° C., the heat and the cold which were within the respective ranges could be continuously obtained only by automatically controlling the high temperature valve 2, the low temperature valve 6, the valves 9, 12 and 19, and the compressor 1.

Pipes of 19.05$\phi\times$1.2 t mm were used to provide the condenser 3 having a resisting pressure of 45 kg/cm$^2$G and a heat conduction area of 0.95 m$^2$. Also, pipes of 9.53$\phi\times$0.41 t mm were used to provide the condenser 7 having a resisting pressure of 42 kg/cm$^2$ and a heat conduction area of 2.35 m$^2$. Furthermore, pipes of 9.53$\phi\times$0.41 t mm were used to provide the first heat exchanger, and also the second heat exchanger having a resisting pressure of 42 kg/cm$^2$G and a heat conduction area of 5.5 m$^2$.

This apparatus had dimensions of less than 1130 H×890 W ×600 L mm, and the entire weight of the apparatus was about 95 kg. The apparatus expended electric power in the amount of about 3 KW/hr and generated heat in the amount of 16500 Kcal per hour and a cooling effect in the amount of 10850 Kcal/hr. Thus, the heat in the amount of 5500 Kcal and the cold in the amount of 3620 Kcal/1KW/hr can be utilized.

In contrast, a conventional electric hot water boiler which contains 380 liters of hot water consumes 4 KW/hr of electric power, occupies a volume 2000 H×900 W×900 L mm, and the conventional boiler requires about 2.7 times volume of the apparatus according to the present invention. The conventional boiler can supply only 864 Kcal of the heat per 1 KW/hr. Thus, the apparatus according to the present invention, when compared with the conventional boiler, can supply about 6.4 times the heat and 4.1 times the cold in spite of a small volume taken up by the present invention, and accordingly, the total available energy amounts to about more than 10 times; thus, resulting in remarkable advantages and benefits.

While the invention has been particularly shown and described in reference to preferred embodiments thereof, it will be understood by those skilled in the art that changes in form and details may be made therein without departing from the spirit and scope of the invention.

What is claimed is:

1. A method for heating and cooling with a refrigerant comprising the steps of:

compressing a refrigerant by a compressor;

circulating the refrigerant to and from the compressor through a condenser, an expansion valve and an evaporator, in this order;

heating a first fluid with the heat generated in the condenser;

cooling a second fluid with the cooling effect or cold generated in the evaporator;

when heat is low and a temperature of the first fluid is decreased, changing the flow passages of the refrigerant from entering into the evaporator to entering into a second heat-exchanger wherein the refrigerant is heated, and the heated refrigerant is entered into the compressor and circulated; and when the cold is low and a temperature of the second fluid is increased, changing the flow passages of the refrigerant from entering into the condenser to entering into a first heat exchanger wherein the refrigerant is cooled, and the cooled refrigerant is entered into the evaporator and circulated.

2. A method for heating and cooling with a refrigerant comprising the steps of:

compressing the refrigerant with a compressor;

circulating the refrigerant to and from the compressor through a condenser, an expansion valve and an evaporator, in this order;

heating a first fluid by the heat generated in the condenser;

cooling a second fluid by the cooling effect or cold generated in the evaporator 7;

when a temperature of the first fluid is decreased below a desired temperature but a temperature of the second fluid is within a desired range, changing the flow passages of the refrigerant from entering into the evaporator to entering into a second heat exchanger wherein the refrigerant is heated, and the heated refrigerant is entered into the compressor and circulated, when a temperature of the second fluid is elevated above a desired temperature but a temperature of the first fluid is within a desired range, changing the flow passages of the refrigerant from entering into the condenser to entering into a first heat exchanger wherein the refrigerant is cooled, and the cooled refrigerant is entered into the evaporator and circulated.

* * * * *